US007591694B2

(12) United States Patent
Osada

(10) Patent No.: US 7,591,694 B2
(45) Date of Patent: Sep. 22, 2009

(54) FEMALE TERMINAL FOR CONNECTOR, CONNECTOR, AND ELECTRICAL CONNECTION DEVICE

(75) Inventor: Tsuyoshi Osada, Yokohama (JP)

(73) Assignee: J.S.T. Mfg. Co., Ltd., Osaka-shi (JP)

( * ) Notice: Subject to any disclaimer, the term of this patent is extended or adjusted under 35 U.S.C. 154(b) by 0 days.

(21) Appl. No.: 12/035,065

(22) Filed: Feb. 21, 2008

(65) Prior Publication Data

US 2008/0207009 A1 Aug. 28, 2008

(30) Foreign Application Priority Data

Feb. 23, 2007 (JP) ..... 2007-043255

(51) Int. Cl.
*H01R 13/11* (2006.01)

(52) U.S. Cl. ..... 439/852

(58) Field of Classification Search ..... 439/852, 439/862, 851, 816

See application file for complete search history.

(56) References Cited

U.S. PATENT DOCUMENTS 1,194,122 A * 8/1916 Ball ..... 439/852
3,406,376 A * 10/1968 Varrin ..... 439/852
6,699,059 B2 3/2004 Nagamine et al.

FOREIGN PATENT DOCUMENTS

JP 2002-324638 11/2002

* cited by examiner

*Primary Examiner*—Neil Abrams
*Assistant Examiner*—Phuong Nguyen
(74) *Attorney, Agent, or Firm*—Oblon, Spivak, McClelland, Maier & Neustadt, L.L.P.

(57) ABSTRACT

A female terminal for connector is electrically connected to a pin, and the pin is electrically connected to a squib to ignite an airbag. The female terminal for connector includes a tubular external wall part and a spring part contacting the pin. A tip portion of the spring part is capable of swinging so as to deflect from a main body portion. The external wall part is formed into a shape having two curved portions disposed to face one another in a swinging direction so as to be outward convex in a radial cross section, and two joining portions to linearly joint ends of the two curved portions together, and the external wall part is formed such that an outside diameter in the swinging direction of the spring part is made larger than an outside diameter in a direction perpendicular to the swinging direction.

10 Claims, 12 Drawing Sheets

FEMALE TERMINAL FOR CONNECTOR, CONNECTOR, AND ELECTRICAL CONNECTION DEVICE

BACKGROUND OF THE INVENTION

1. Field of the Invention

The present invention relates to a female terminal for connector which is electrically connected to a male terminal electrically connected to a squib to ignite an airbag, a connector having the female terminal for connector, and an electrical connection device having the connector.

2. Description of Related Art

An airbag system has an airbag assembly attached to a hidden compartment portion in a driver's cabin of a vehicle, and an electrical or electronic control system. The control system and the airbag assembly are connected to one another with a wire harness (where this is named generically as products that electric cables and cables are processed). Where the airbag assembly includes a squib to ignite an airbag (airbag ignition device). Then, an electrical connection device is provided to the above-described wire harness, so as to allow an easier electric connection of the control system and the airbag assembly having been separately attached to respective predetermined positions (as an example, refer to Japanese Published Unexamined Patent Application No. 2002-324638). Then, the electrical connection device includes a female side connector (a second component) and a socket (a concave portion formed in a housing for airbag inflator).

The above-described electrical connection device includes a short-circuiting element, and a so-called short-circuiting clip is provided to the short-circuiting element. The short-circuiting clip is a metal component disposed so as to be capable of electrically short-circuiting conductor wires mutually in the connector (or the socket) before the connector and the socket are engaged with one another. Such a short-circuiting clip is provided as a safety means for preventing an airbag assembly from malfunctioning due to electric charges leaked during a production process and an improper connection.

Further, in a connector as described above, as an electrical terminal (a female terminal for connector) to be engaged with a pin (male terminal) disposed at a socket side for an electrical connection, there may be used a terminal (refer to FIG. 4 in Japanese Published Unexamined Utility Model Application No. S56-57478) whose radial cross section is a circular shape, or a terminal (refer to FIG. 1 in Japanese Published Unexamined Patent Application No. 2006-228759) whose radial cross section is a rectangular form.

SUMMARY OF THE INVENTION

When a radial cross-sectional shape of a female terminal for connector is formed into a circular shape as described in, for example, Japanese Published Unexamined Utility Model Application No. S56-57478, it is usually the case that: a cross-sectional shape of the terminal protective part is formed into a circular shape; and an appropriate clearance is ensured between (i) the female terminal for connector, and (ii) the terminal protective part of a housing which part serves as an insulator and surrounds periphery of an external wall part of the terminal whereby the female terminal is formed into a floating gate. Moreover, in accordance therewith, it is necessary to make a cross-sectional shape of an insertion hole which is provided to a short-circuiting element at the socket side, and into which the terminal protective part is inserted, into a circular shape. This is to form a guideway for insertion of the female side connector (i.e., insertion of the terminal protective part) in order for the female side connector to be inserted in the axial direction of the pin for the purpose of prevention of a torsional deformation of the pin due to the female side connector being inserted in an oblique direction with respect to an axial direction of the pin when the female terminal for connector is inserted into the socket.

Then, in a case in which a cross-sectional shape of the female terminal for connector is formed into another shape such as a quadrangular shape as well, it is necessary for cross-sectional shapes of the terminal protective part and the insertion hole of the short-circuiting element to conform with the cross-sectional shape of the female terminal for connector.

First, in a case in which the cross-sectional shapes of the female terminal for connector, the terminal protective part, and the insertion hole are formed into circular shapes, when a pin is disposed on the center of the insertion hole, a radial distance from the pin to the inner peripheral surface of the insertion hole is constant, and provided that a size of the insertion hole is set to be smaller in consideration of a board thickness of the female terminal for connector and the like, even when the female side connector is obliquely inserted into the socket portion, because the distance between the pin and the inner peripheral surface is constant and short, torsion of the pin is difficult to occur, which makes it possible to prevent a deformation of the pin.

Meanwhile, usually, a spring part is provided to a female terminal for connector used for an electrical connection device as described above, and by elastically sandwiching a pin between a contact part and the spring part provided to an external wall part of the female terminal for connector during a connection time, an electrical connection between the pin and the female terminal for connector is secured, which ensures contact reliability. Then, in order to simplify the structure of the female terminal for connector by reducing the number of components, the external wall part and the spring part of the female terminal for connector are integrally formed of a metal plate or the like.

As described above, in a case in which the cross-sectional shapes of the female terminal for connectors, the terminal protective parts, and the insertion holes are formed into circular shapes, the spring part contacts the external wall part when radially-outwardly moving to limit its movement. Therefore, it is difficult in design to make a radial distance at which the spring part is capable of elastically swinging (an allowable distance/an amount of displacement possible for elastic swinging) greater. Then, in order to ensure contact reliability by the spring part in a state in which an amount of displacement of the spring part is small, it is necessary to ensure contact reliability by improving the rigidity of the main body portion of the spring part due to a plate member separated from the external wall part being attached to a main body portion of the spring part. However, in this case, a separate component is required, which makes the terminal structure complicated.

On the other hand, in a case in which the cross-sectional shapes of the female terminal for connector, the terminal protective part, and the insertion hole are formed into quadrangular shapes, provided that the swinging direction of the spring part and a side (long side) direction as seen in the cross section are coincided with one another, when the spring part moves, it is difficult for the external wall part and the spring part to contact each other, which makes it possible to make a distance at which the spring part is capable of elastically swinging greater than that in a case in which the cross-sectional shapes are circular shapes. Therefore, even when the spring part is formed integrally with the external wall part of the female terminal for connector, it is possible to ensure contact reliability by the spring part without attaching a separate component. However, in this case, differently from the case in which the cross-sectional shapes are circular shapes, a radial distance between the pin and the inner peripheral surface is not constant, and even when a size of one side of a cross section of a quadrangular shape is set to be smaller in consideration of a board thickness of the female terminal for connector and the like in the same way as a size of the diameter in a case of circular shapes, because a diagonal distance between the pin and the inner peripheral surface of the insertion hole is made longer than a distance in a side direction, when the female side connector is inserted obliquely, a deformation due to torsion of the pin is easily caused.

Then, in a case in which the cross-sectional shapes of the female terminal for connector, the terminal protective part, and the insertion hole are quadrangular shapes, in order to prevent a torsional deformation of the pin, it can be conceived that the height of the inner peripheral wall of the insertion hole is set as high as possible as compared with the height of the pin to avoid a contact between the terminal protective part and the pin.

However, a projected height of the housing of the short-circuiting element as seen in the cross section from the top surface (a plane in which the socket is formed) of an airbag inflator is required to be set as low as possible in order to prevent breakage, deformation, and the like of the tip portion projected from the top surface of the inflator. For example, there is specified in the VDA standard that a projected height is up to 0.3 mm. For this reason, in order to set the height of the short-circuiting element projected from the top surface of the inflator low, it is preferable to set the height of the inner peripheral wall of the insertion hole as low as possible.

For the reasons as described above, in a case in which the radial cross-sectional shapes of the female terminal for connector, the terminal protective part, and the insertion hole are formed into circular shapes, in contrast to the fact that a torsional deformation of the pin is difficult to occur, it is difficult with a simple structure to ensure contact reliability by the spring part integrally formed therewith. Further, in a case in which the radial cross-sectional shapes of the female terminal for connector, the terminal protective part, and the insertion hole are formed into quadrangular shapes, in contrast to the fact that it is easy to ensure contact reliability by the spring part integrally formed therewith, it is difficult to prevent a torsional deformation of the pin without making the height of the short-circuiting element projected from the top surface of the inflator higher.

Then, it is an object of the present invention to provide a female terminal for connector, a connector, and an electrical connection device, which are capable of not only ensuring contact reliability by a spring part, but also preventing torsion of a male terminal with a simple structure without making the height of a short-circuiting element higher.

In order to achieve the above-described object, a female terminal for connector according to the present invention is electrically connected to a male terminal electrically connected to a squib to ignite an airbag, and the female terminal for connector includes an external wall part formed in a tubular form, and a spring part which is integrally formed with the external wall part inside the external wall part, and which contacts the male terminal during a connection to the male terminal. Then, the spring part has a main body portion and a tip portion, and continues into the external wall part at the main body portion, and the tip portion is capable of swinging so as to deflect from the main body portion, and the external wall part is formed into a shape having two curved portions disposed to face one another in a swinging direction of the spring part so as to be outward convex in the radial cross section of the external wall part, and two joining portions to linearly joint ends of the two curved portions together, and the external wall part is formed such that an outside diameter in the swinging direction of the spring part is made larger than an outside diameter in a direction perpendicular to the swinging direction in the radial cross section of the external wall part.

In accordance with the structure, radial cross-sectional shapes of an outer peripheral surface of the external wall part of the female terminal for connector, an inner peripheral surface and an outer peripheral surface of a terminal protective part surrounding the female terminal for connector, and an inner peripheral surface of an insertion hole in a short-circuiting element are formed into shapes having two curved portions disposed to face one another so as to be outward convex, and two joining portions to linearly joint ends of the two curved portions together. Then, the two curved portions are disposed to face one another in the swinging direction of the spring part. Then, diameters in the swinging direction of those are longer than diameters in a direction perpendicular to the swinging direction. Therefore, because a range within which the spring part is capable of elastically swinging is made larger, as compared with a case in which a cross-sectional shape of the external wall part is a circular shape, it is easy to ensure contact reliability by the spring part integrally formed therewith. In accordance therewith, it is possible to ensure contact reliability with a simple structure without attaching a separate member, which does not increase the number of components. Further, as compared with a case in which a cross-sectional shape of the external wall part is a quadrangular shape, a torsional deformation of the pin is difficult to occur, and it is possible to prevent a torsional deformation of the pin without making the height of the short-circuiting element projected from the top surface of the inflator higher. For the reasons as described above, it is possible to not only ensure contact reliability by the spring part, but also prevent torsion of the male terminal with a simple structure without making the height of the short-circuiting element higher.

Further, in the female terminal for connector according to the present invention, the curved portions may be circular arc shapes. In accordance therewith, it is possible to further simplify the structure of the female terminal for connector.

Further, in the female terminal for connector according to the present invention, the curved portions may be composed of a plurality of linear portions jointed together. In accordance therewith, it is possible to easily form the female terminal for connector by bending work.

Further, in order to achieve the above-described object, a female terminal for connector according to the present invention is electrically connected to a male terminal electrically connected to a squib to ignite an airbag, and the female terminal for connector includes an external wall part formed in a tubular form, and a spring part which is integrally formed with the external wall part inside the external wall part, and which contacts the male terminal during a connection to the male terminal. Then, the spring part has a main body portion and a tip portion, and continues into the external wall part at the main body portion, and the tip portion is capable of swinging so as to deflect from the main body portion, and the external wall part is formed into an elliptic shape with a swinging direction of the spring part as a long axis direction in the radial cross section of the external wall part.

In accordance with the structure, radial cross-sectional shapes of an outer peripheral surface of the external wall part of the female terminal for connector, an inner peripheral surface and an outer peripheral surface of a terminal protective part surrounding the female terminal for connector, and an inner peripheral surface of an insertion hole in a short-circuiting element are formed into elliptic shapes. Then, the swinging direction of the spring part is a long axis direction in the cross section of the elliptic shapes. Therefore, because a range within which the spring part is capable of elastically swinging is made larger, as compared with a case in which a cross-sectional shape of the external wall part is a circular shape, it is easy to ensure contact reliability by the spring part integrally formed therewith. In accordance therewith, it is possible to ensure contact reliability with a simple structure without attaching a separate member, which does not increase the number of components. Further, as compared with a case in which a cross-sectional shape of the external wall part is a quadrangular shape, a torsional deformation of the pin is difficult to occur, and it is possible to prevent a torsional deformation of the pin without making the height of the short-circuiting element projected from the top surface of the inflator higher. For the reasons as described above, it is possible to not only ensure contact reliability by a spring part, but also prevent torsion of the male terminal with a simple structure without making the height of the short-circuiting element higher.

Further, in the female terminals for connector according to the present invention, the spring part may be formed in a long plank shape along an axial direction of the external wall part, and a convex portion formed to be along the axial direction and to project in the swinging direction may be formed in the main body portion of the spring part. In accordance therewith, by forming the convex portion formed to project in the swinging direction in order to increase the rigidity of the main body portion of the spring part, it is possible to not only make effective use of a space in the swinging direction in the radial cross section of the external wall part, but also further improve contact reliability by the spring part.

Further, in order to achieve the above-described object, a connector according to the present invention includes a pair of the female terminals for connector according to any one of the aspects, a female side housing to which the pair of female terminals for connector are attached, and which insulates the pair of female terminals for connector, and a short-circuiting element which electrically short-circuits a pair of male terminals electrically connected to the pair of female terminals for connector, and is engaged with a concave portion provided in a housing for airbag inflator. Further, the female side housing has a terminal protective part formed in a tubular form so as to surround a periphery in a radial direction of the external wall part, the terminal protective part is formed such that an inner peripheral surface and an outer peripheral surface thereof are along the outer peripheral surface of the external wall part in the radial cross section of the terminal protective part, a pair of insertion holes into which the terminal protective part is inserted are formed in the short-circuiting element, and the insertion hole is formed such that an inner peripheral surface is along an outer peripheral surface of the terminal protective part.

In accordance with the structure, because a range within which the spring part is capable of elastically swinging is made larger, as compared with a case in which cross-sectional shapes of the external wall part, the terminal protective part, and the insertion hole are circular shapes, it is easy to ensure contact reliability by the spring part integrally formed therewith. In accordance therewith, it is possible to ensure contact reliability with a simple structure without attaching a separate member, which does not increase the number of components. Further, as compared with a case in which cross-sectional shapes of the external wall part, the terminal protective part, and the insertion hole are quadrangular shapes, a torsional deformation of the pin is difficult to occur, and it is possible to prevent a torsional deformation of the pin without making the height of the short-circuiting element projected from the top surface of the inflator higher. As described above, it is possible to not only ensure contact reliability by the spring part, but also prevent torsion of the male terminal with a simple structure without making the height of the short-circuiting element higher.

Further, in order to achieve the above-described object, an electrical connection device according to the present invention includes the connector, a housing for airbag inflator with a concave portion in an outer surface, and a pair of male terminals which are electrically connected to a squib to ignite an airbag, and are disposed so as to be upright from the bottom face to the vicinity of the opening of the concave portion at a central part of the concave portion.

In accordance with the structure, because a range within which the spring part is capable of elastically swinging is made larger, as compared with a case in which cross-sectional shapes of the external wall part, the terminal protective part, and the insertion hole are circular shapes, it is easy to ensure contact reliability by the spring part integrally formed therewith. In accordance therewith, it is possible to ensure contact reliability with a simple structure without attaching a separate member, which does not increase the number of components. Further, as compared with a case in which cross-sectional shapes of the external wall part, the terminal protective part, and the insertion hole are quadrangular shapes, a torsional deformation of the pin is difficult to occur, and it is possible to prevent a torsional deformation of the pin without making the height of the short-circuiting element projected from the top surface of the inflator higher. For the reasons as described above, it is possible to not only ensure contact reliability by the spring part, but also prevent torsion of the male terminal with a simple structure without making the height of the short-circuiting element higher. Further, because the male terminals are disposed so as to be upright from the bottom face to the vicinity of the opening of the concave portion, it is easy to connect to the female terminals for connector.

BRIEF DESCRIPTION OF THE DRAWINGS

Other and further objects, features and advantages of the invention will appear more fully from the following description taken in connection with the accompanying drawings in which.

| | |
|---|---|
| 1 | Electrical connection device |
| 2g | Terminal protective part |
| 2h | Female side housing |
| 2j | Inner peripheral surface (of terminal protective part) |
| 2j | Outer peripheral surface (of terminal protective part) |
| 4h | Socket (concave portion) |
| 4i | Housing for airbag inflator |
| 4p | Pin (male terminal) |
| 4s | Squib |
| 5, 105, 205, 305 | Female terminal for connector |
| 5b | Main body portion |
| 5e, 305e | Ends |
| 5i | Convex portion |
| 5j | Outer peripheral surface (of external wall part) |
| 5s, 105s, 205s, 305s | Spring part |
| 5t, 105t, 205t, 305t | Tip portion |
| 5w, 105w, 205w, 305w | External wall part |
| 5y, 305y | Linear portion |
| 5z, 305z | Curved portion |
| 6 | Short-circuiting element |
| 6h | Insertion hole |
| 6k | Inner peripheral surface (of short-circuiting element) |

DESCRIPTION OF THE PREFERRED EMBODIMENTS

Hereinafter, preferred embodiments of the present invention will be described with reference to the drawings.

(Entire Structure)

Figure 1:
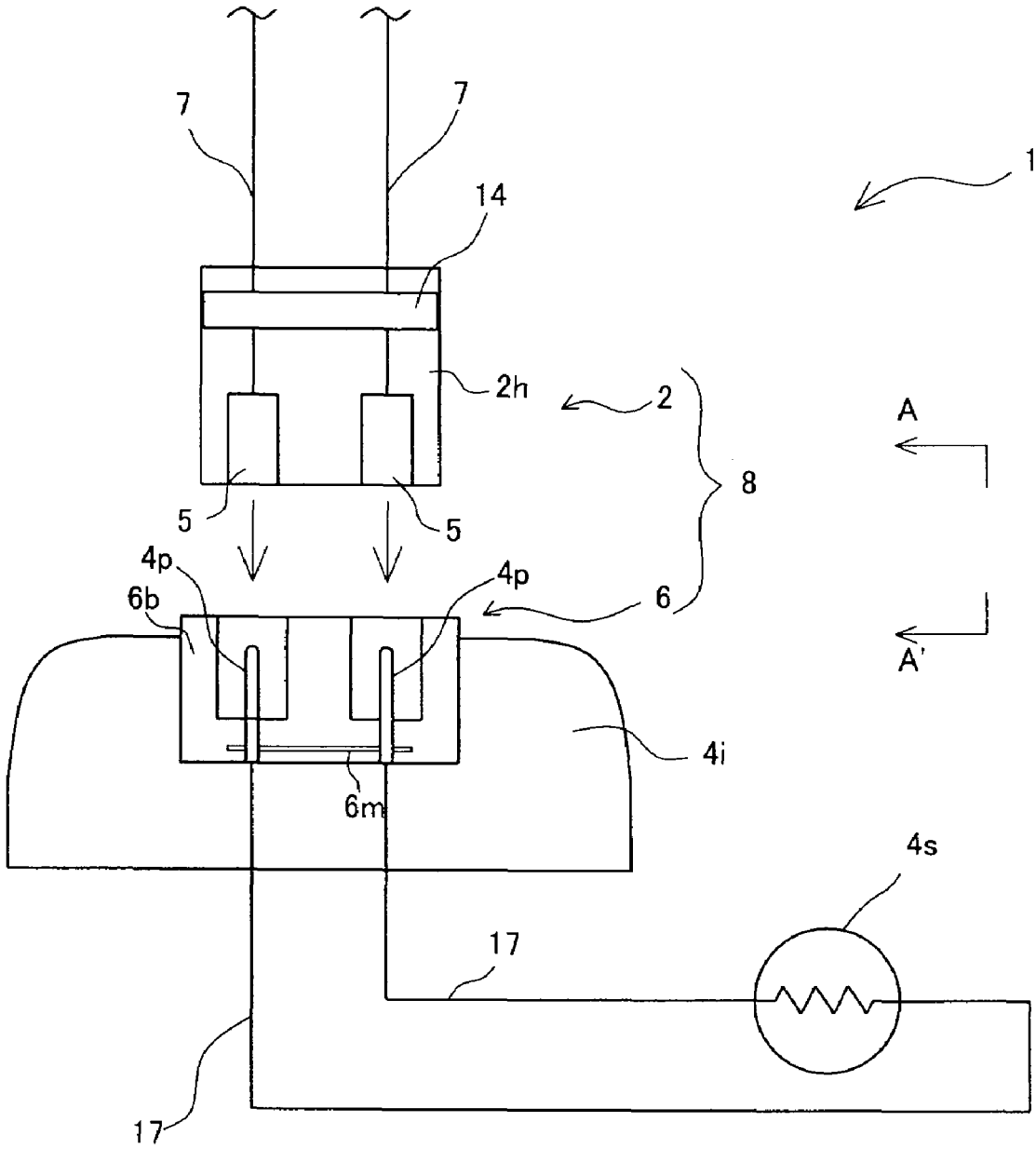
FIG. 1 is a block schematic diagram of an electrical connection device according to one embodiment of the present invention.

First, an entire structure of an electrical connection device according to one embodiment of the present invention will be described with reference to FIG. 1. FIG. 1 is a block schematic diagram of the electrical connection device according to the present embodiment.

As shown in FIG. 1, the electrical connection device 1 is composed of a connector 8, a pair of pins (male terminals) 4*p* and 4*p*, and a housing 4*i* for airbag inflator. The connector 8 is composed of a plug 2 and a short-circuiting element 6. Further, the short-circuiting element 6 has a short-circuiting clip 6*m* and a housing 6*b*, and is attached to the housing 4*i*. The plug 2 has female terminals for connector 5 and 5, and the pins 4*p* and 4*p* are attached to the housing 4*i*.

The female terminals for connector 5 and 5 which are on one side of the electrical connection device 1 are connected to electric cables 7 and 7, and the pins 4*p* and 4*p* which are on the other side are connected to electric cables 17 and 17. Further, the electric cables 17 and 17 are connected to a squib (airbag ignition device) 4*s*. The squib 4*s* is to carry out an ignition operation when sufficient electric energy is provided thereto. Then, as shown by the arrows in FIG. 1, when the plug 2 is connected to the short-circuiting element 6 in the electrical connection device 1, i.e., when the pins 4*p* and 4*p* are connected to the female terminals for connector 5 and 5, a direct-current circuit capable of generating heat in the squib 4*s* based on an instruction from an unillustrated airbag control system is formed. In addition, due to this heat generation, an unillustrated gas generation material is ignited to generate gas, which makes an unillustrated airbag deploy.

Figure 2:
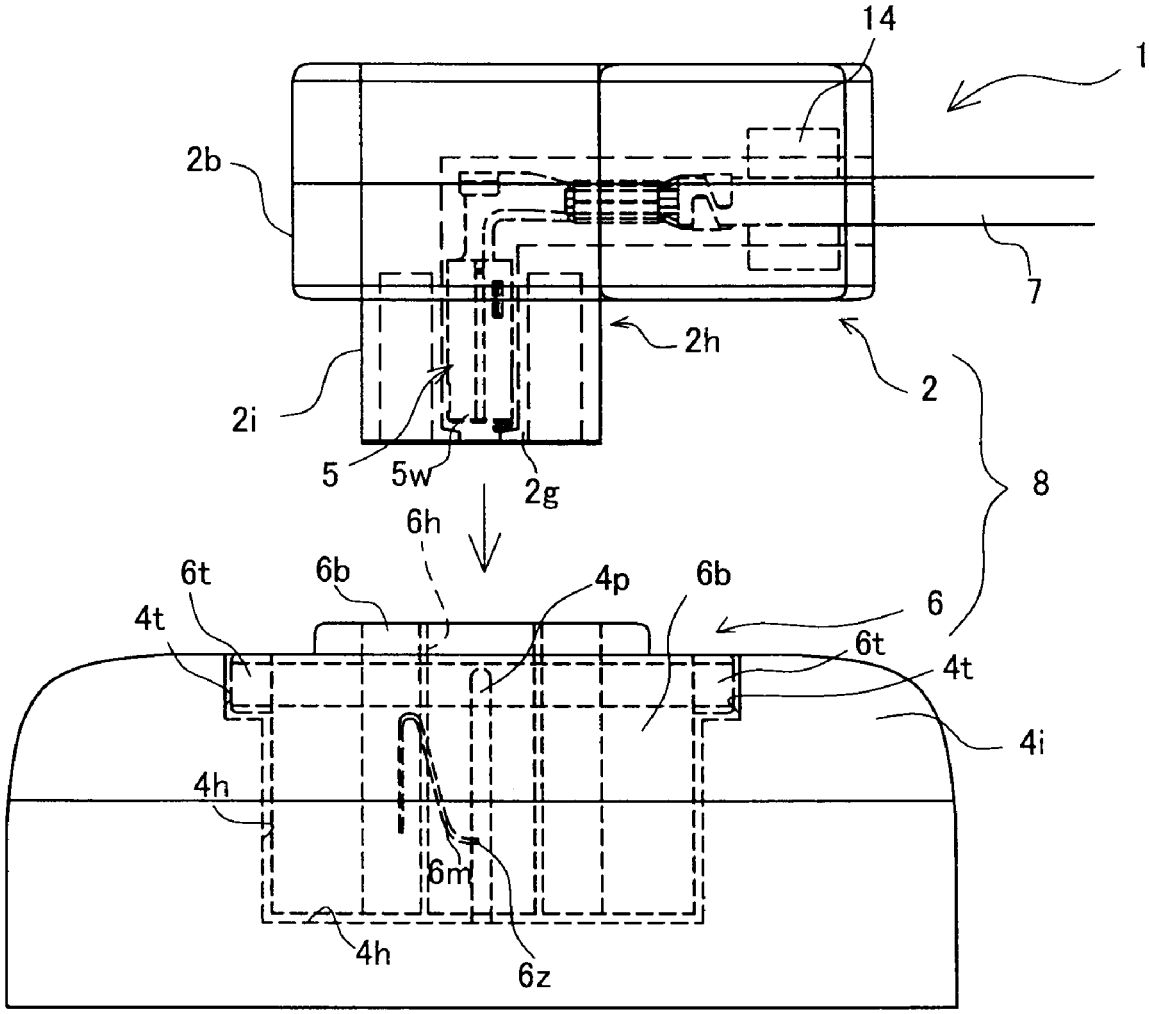
FIG. 2 is an explanatory schematic diagram showing a structure of the electrical connection device of FIG. 1 more concretely.

FIG. 2 is an explanatory schematic diagram showing the structure of the electrical connection device 1 more concretely. FIG. 2 corresponds to a side view of FIG. 1 (a diagram seen from the arrowed line A-A'), and only one sides of the pins 4*p* and 4*p* and the female terminals for connector 5 and 5 shown in pairs in FIG. 1 are in FIG. 2. In FIG. 2, the internal structures which do not come to the front are shown by the broken lines, and the electric wires 17 and 17 and the squib 4*s* are omitted from being shown. Hereinafter, the concrete structures of the respective parts will be described with reference to FIG. 2.

As shown in FIG. 2, the electrical connection device 1 includes the housing 4*i* for airbag inflator having a socket (concave portion) 4*h* in its outer surface, the pin (male terminal) 4*p* disposed in the central portion of the socket 4*h*, and the connector 8.

(Housing for Airbag Inflator)

First, the details of the housing for inflator 4*i* and the pins 4*p* and 4*p* will be described. The housing 4*i* for airbag inflator is formed in a cylindrical shape whose corners are chamfered at the top surface portion, and has the socket (concave portion) 4*h* in its outer surface (the upper portion in FIG. 2). The socket 4*h* is formed as a concave portion in the housing 4*i*, and is open upward in FIG. 2. Further, two concave portions 4*t* and 4*t* used for positioning the short-circuiting element 6 which will be described later are provided to project radially-outwardly.

(Pins)

A pair of the pins 4*p* and 4*p* are electrically connected to the squib 4*s* to ignite an airbag via the electric wires 17 and 17 (which are omitted in FIG. 2), and as described above, those are respectively disposed so as to be upright from the bottom face to the vicinity of the opening of the socket 4*h*.

(Connector)

Next, the details of the connector 8 will be described. The connector 8 is composed of the plug 2 and the short-circuiting element 6. Hereinafter, the concrete structures of the plug 2 and the short-circuiting element 6 will be described.

(Plug)

The plug 2 is composed of the female terminals for connector 5 and 5 and a female side housing 2*h*.

(Female Terminals for Connector)

Figure 3:
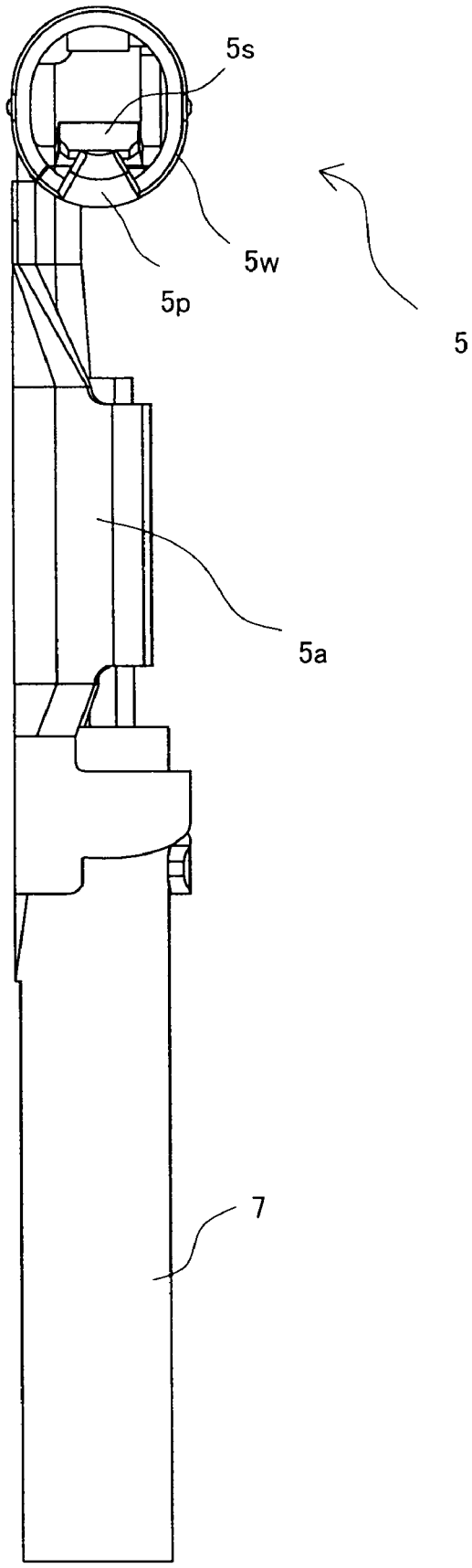
FIG. 3 is a front schematic view of a female terminal for connector of FIG. 1.
Figure 4:
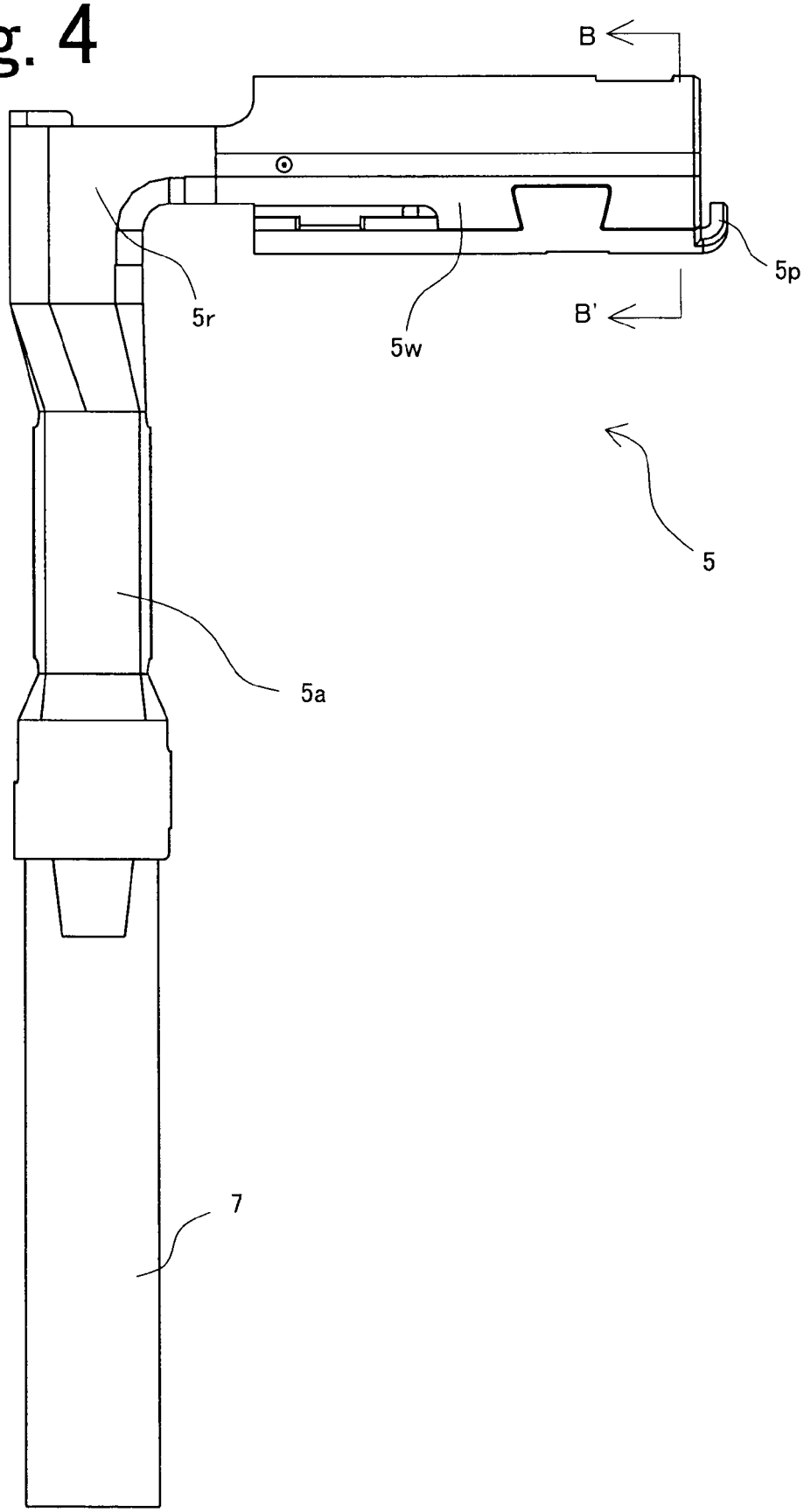
FIG. 4 is a side schematic view of the female terminal for connector of FIG. 1.
Figure 5:
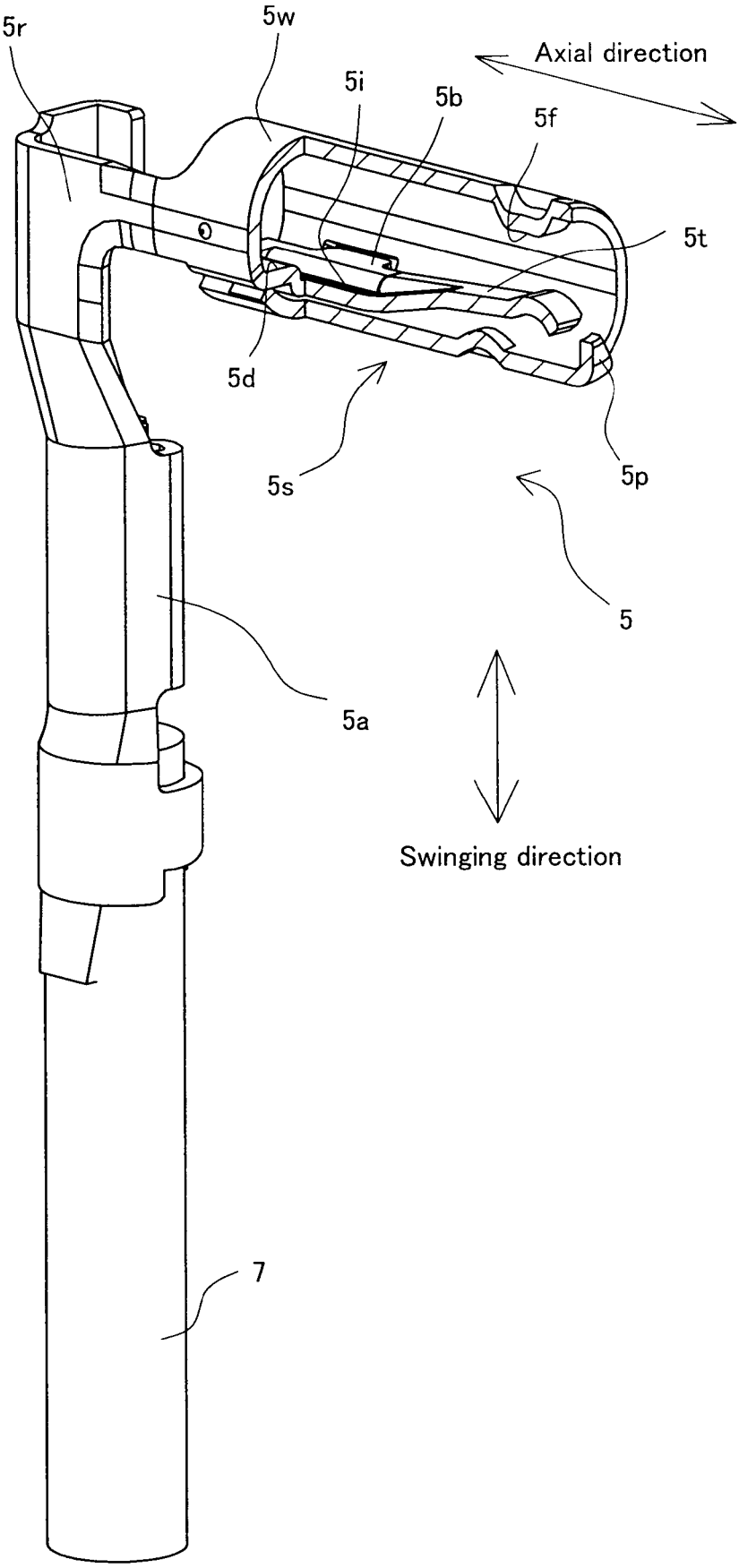
FIG. 5 is a perspective view schematically presenting a cross section of the female terminal for connector of FIG. 1.

The female terminal for connector 5 will be described with reference to FIG. 3 to FIG. 5. FIG. 3, FIG. 4, and FIG. 5 respectively show a front view, a side view, and a perspective cross-sectional schematic diagram of the female terminal for connector 5. In FIG. 3, a state in which the electric wire 7 is attached to the female terminal for connector 5 is shown. As described above, a pair of the female terminals for connector 5 are provided in the connector 8. However, the respective structures thereof are the same, and one of the female terminals for connector 5 will be described.

As described above, the female terminal for connector 5 is to be electrically connected to the pin 4*p*. As shown in FIG. 3, FIG. 4, and FIG. 5, the female terminal for connector 5 has an external wall part 5*w*, a spring part 5*s*, a spring protective part 5*p*, and an arm portion 5*a*. Then, the female terminal for connector 5 composed of those is formed of one metal plate through various processes, and is just one as the number of components.

The external wall part 5*w* is formed in a tubular form, and is structured and sized so as to be capable of receiving the pin 4. Further, the arm portion 5*a* crosses the external wall part 5*w* at substantially right angles, and the arm portion 5*a* and the external wall part 5*w* are jointed together at a joining portion 5*r*. In this way, the female terminal for connector 5 is extended from the tubular external wall part 5*w* to turn around so as to be L-shaped, and is connected to the electric wire 7 there. The electric wire 7 is insulated with an outer sheath, and at an end of the outer sheath portion, an internal conductor is exposed for an electrical connection to the female terminal for connector 5. Then, the electric wire 7 is attached by any conventional method, for example, by crimping one part of the female terminal for connector 5 onto the periphery of the end of the conductor of the electric wire 7.

The spring protective part 5*p* is to prevent damage of the spring part 5*s* (collision avoidance mechanism) due to the spring part 5*s* and the pin 4*p* (or a continuity test pin) contacting each other (for example, at an angle at which the both are perpendicular to one another). As shown in the drawing, the spring protective part 5*p* is formed to continue from the end of the external wall part 5*w* into the radially inner side of the external wall part 5*w*.

The spring part 5*s* is formed integrally with the external wall part 5*w* inside the external wall part 5*w*, and serves as a portion contacting the pin 4*p* at the time of connecting to the pin 4*p*. The spring part 5*s* is formed in a long plank shape along an axial direction of the external wall part 5*w* (refer to a direction of the arrow in the drawing).

Further, the spring part 5*s* has a main body portion 5*b* and a tip portion 5*t*. A continuous portion 5*d* is provided to the main body portion 5*b*, and the spring part 5*s* continues into the external wall part 5*w* at the continuous portion 5*d* of the main body portion 5*b*, and is integrated with the external wall part 5*w*. The tip portion 5*t* is capable of swinging so as to deflect from the main body portion 5*b* of the spring part 5*s*. In FIG. 5, a swinging direction is a vertical direction on the paper space (refer to the arrow in FIG. 5). Further, a convex portion 5*i* formed in an axial direction and so as to project in the swinging direction is formed on the main body portion 5*b* of the spring part 5*s*. In the present embodiment, the convex portion 5*i* is provided so as to (radially) project to the outer side of the swinging direction. However, the convex portion 5*i* may be provided so as to project to the inner side opposite thereto. Further, in the external wall part 5*w*, a contact convex portion 5*f* is formed to project at a position radially facing the position at which the spring part 5*s* is disposed. Then, the pin 4*p* is electrically connected to the female terminal for connector 5 by contacting the spring part 5*s* and the contact convex portion 5*f*.

Figure 6:
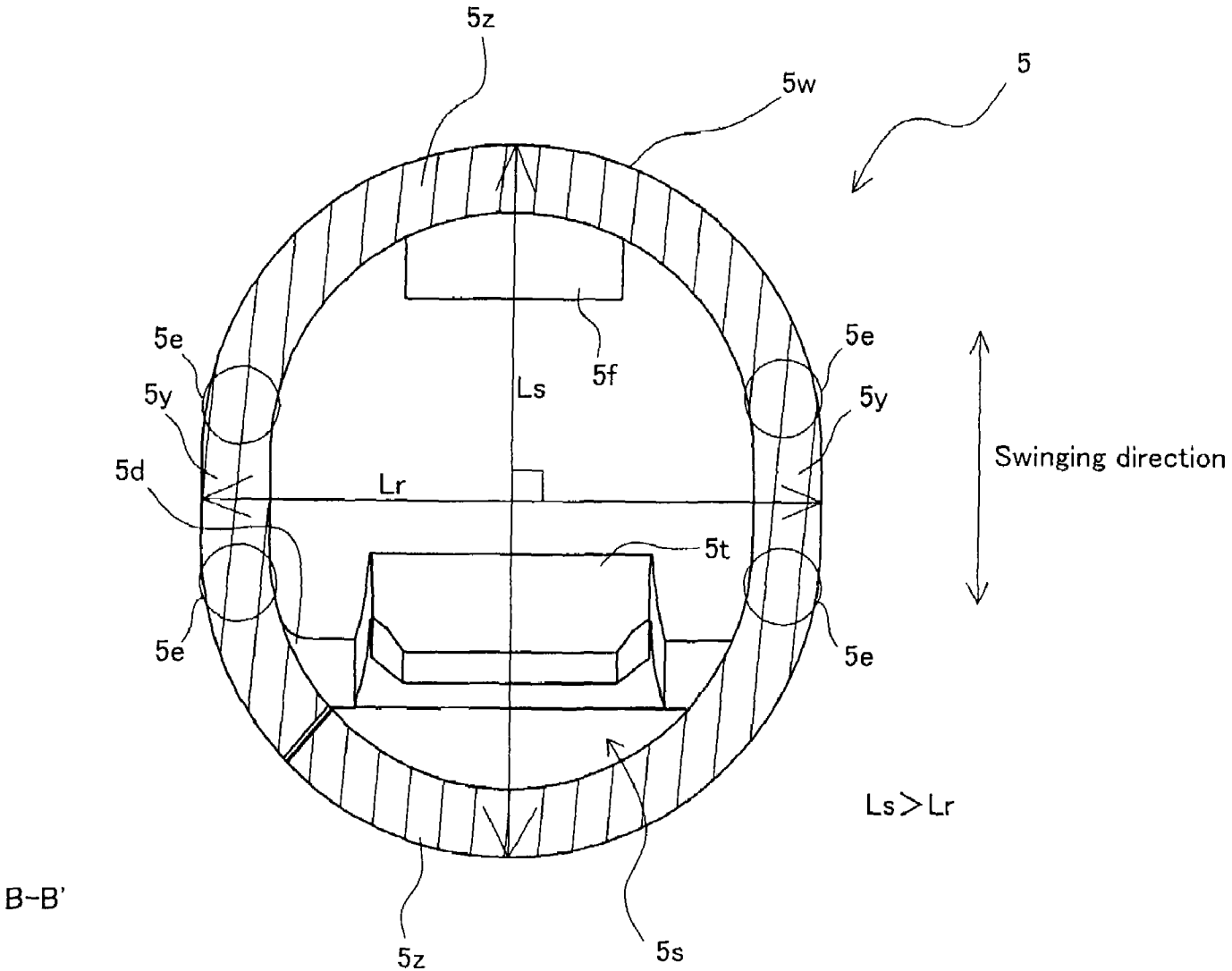
FIG. 6 is a radial cross-sectional schematic diagram of an external wall part.

Next, a shape of the external wall part 5*w* will be described more concretely with reference to FIG. 6. FIG. 6 is a radial cross-sectional schematic diagram of the external wall part 5*w*, and corresponds to a cross-sectional schematic diagram seen from the arrowed line B-B' in FIG. 4. The external wall part 5*w* is formed into a shape including two curved portions 5*z* and 5*z* disposed to face one another in the swinging direction of the spring part 5*s* so as to be outward convex in the radial cross section, ends (5*e* and 5*e*) of the two curved portions 5*z* and 5*z*, and two joining portions 5*y* and 5*y* to linearly joint the ends (5*e* and 5*e*). Further, the external wall part 5*w* is formed in the radial cross section of the external wall part 5*w* such that an outside diameter Ls in the swinging direction of the spring part 5*s* is made larger than an outside diameter Lr in a direction perpendicular to the swinging direction. Further, in the external wall part 5*w*, the maximum diameter is Ls, and the minimum diameter is Lr.

(Female Side Housing)

Next, the female side housing 2*h* will be described with reference to FIG. 1 and FIG. 2. The female side housing 2*h* is a structure to secure mechanical and structural strength of the plug 2, and is formed of a nonconductive plastic material. A pair of the female terminals for connector 5 and 5 are attached to the female side housing 2*h*.

The female side housing 2*h* includes an insertion portion 2*i* and a box-shaped main body portion 2*b* disposed to be substantially L-shaped with respect to the insertion portion 2*i*. Further, a ferrite 14 is disposed inside the main body portion 2*b*. The electric wire 7 passes through the inside of the ferrite 14 to communicate with the outside of the housing. The ferrite 14 is a substantially box-shaped homogeneous substance provided for denoising, and two parallel and cylindrical-tubular through holes pass through the ferrite 14, and the electric wires 7 and 7 pass through the through holes.

Further, the pair of female terminals for connector 5 and 5 are insulated from one another by the female side housing 2*h*. Concretely, a pair of terminal protective parts 2*g* and 2*g* formed in tubular forms so as to surround the peripheries in a radial direction of the external wall parts 5*w* of the female terminals for connector 5 are provided in the female side housing 2*h*. Then, as will be described later, the terminal protective part 2*g* is formed to be along the external wall part 5*w* in the radial cross section.

(Short-Circuiting Element) The short-circuiting element 6 is to electrically short-circuit a pair of the pins 4*p* and 4*p*, and has a short-circuiting clip 6*m* and the housing 6*b*. Further, the housing 6*b* of the short-circuiting element 6 is configured to engage with the socket 4*h* provided in the housing 4*i* for airbag inflator.

A pair of insertion holes 6*h* and 6*h* into which a pair of the terminal protective parts 2*g* and 2*g* are inserted are formed in the short-circuiting element 6. Further, although details thereof will be described later, the insertion hole 6*h* is formed to be along the terminal protective part 2*g* in the radial cross section.

The short-circuiting element 6 is attached to the socket 4*h*, and until the plug 2 is inserted into the short-circuiting element 6, i.e., until the female terminal for connector 5 and the pin 4*p* are mechanically and electrically connected to one another, these are in a short-circuited state due to an electrical connection between the pins 4*p* and 4*p*.

More specifically, the housing 6*b* is made of a molded plastic, and has a shape with a circular outline as seen from the top surface, which is sized so as to be received tightly in the socket 4*h*. Projecting portions 6*t* and 6*t* semi-cylindrically projecting as seen from the top surface, which are disposed and sized so as to be received in the two concave portions 4*t* and 4*t* provided in the socket 4*h* are provided at the sides of the top surface of the housing 6*b*. Due to the projecting portions 6*t* and 6*t* and the concave portions 4*t* and 4*t*, the short-circuiting element 6 is installed in an appropriate direction with respect to the socket 4*h* of the housing 4*i*. The insertion hole 6*h* of the housing 6*b* is provided to pass through at least in a vertical direction to the housing 6*b*. Then, when the short-circuiting element 6 is inserted into the socket 4*h*, because the insertion holes 6*h* and 6*h* are provided, there are no cases in which insertion of the short-circuiting element 6 is prevented from contacting the pins 4*p* and 4*p*. Further, when the plug 2 is inserted into the short-circuiting element 6, because the insertion holes 6*h* and 6*h* are provided (to be guides at the time of insertion), there are no cases in which insertion of the plug 2 is prevented from contacting the pins 4*p* and 4*p*.

The above-described short-circuiting is realized, in concrete terms, by the short-circuiting clip 6*m* held in the short-circuiting element 6. The short-circuiting clip 6*m* is formed of an elastic conductive material such as spring steel. The short-circuiting clip 6*m* as described above is provided as a safety means for preventing an airbag assembly from malfunctioning due to electric charges leaked during a production process and an improper connection. A part of the short-circuiting clip 6*m* is deflected to a direction to touch the pair of pins 4*p* and 4*p*, which forms an electrical short circuit therebetween. The short-circuiting clip 6*m* includes a tabular base, a pair of leg portions bent on the base to extend downward, and a pair of touching portions 6*z* bent at an angle of 90° under the pair of respective leg portions. The respective leg portions are bent step-like in a direction away from the base, to be deflected such that the touching portions 6*z* touch the sides of the both pins 4*p* and 4*p* to be capable of being electrically connected. Then, when the plug 2 is completely inserted into the short-circuiting element 6, the short-circuiting clip 6*m* is pressed by the insertion portion 2*i* of the plug 2 to be separated away from the pin 4*p*, and the short-circuiting is cancelled in accordance therewith. Therefore, the circuit is formed to be capable of performing an ignition operation by the squib 4*s*. In FIG. 2, a situation in which the short-circuiting clip 6*m* touches the pins 4*p* and 4*p* is shown.

(Female Terminals for Connector, Terminal Protective Parts, and Insertion Portion)

Figure 7:
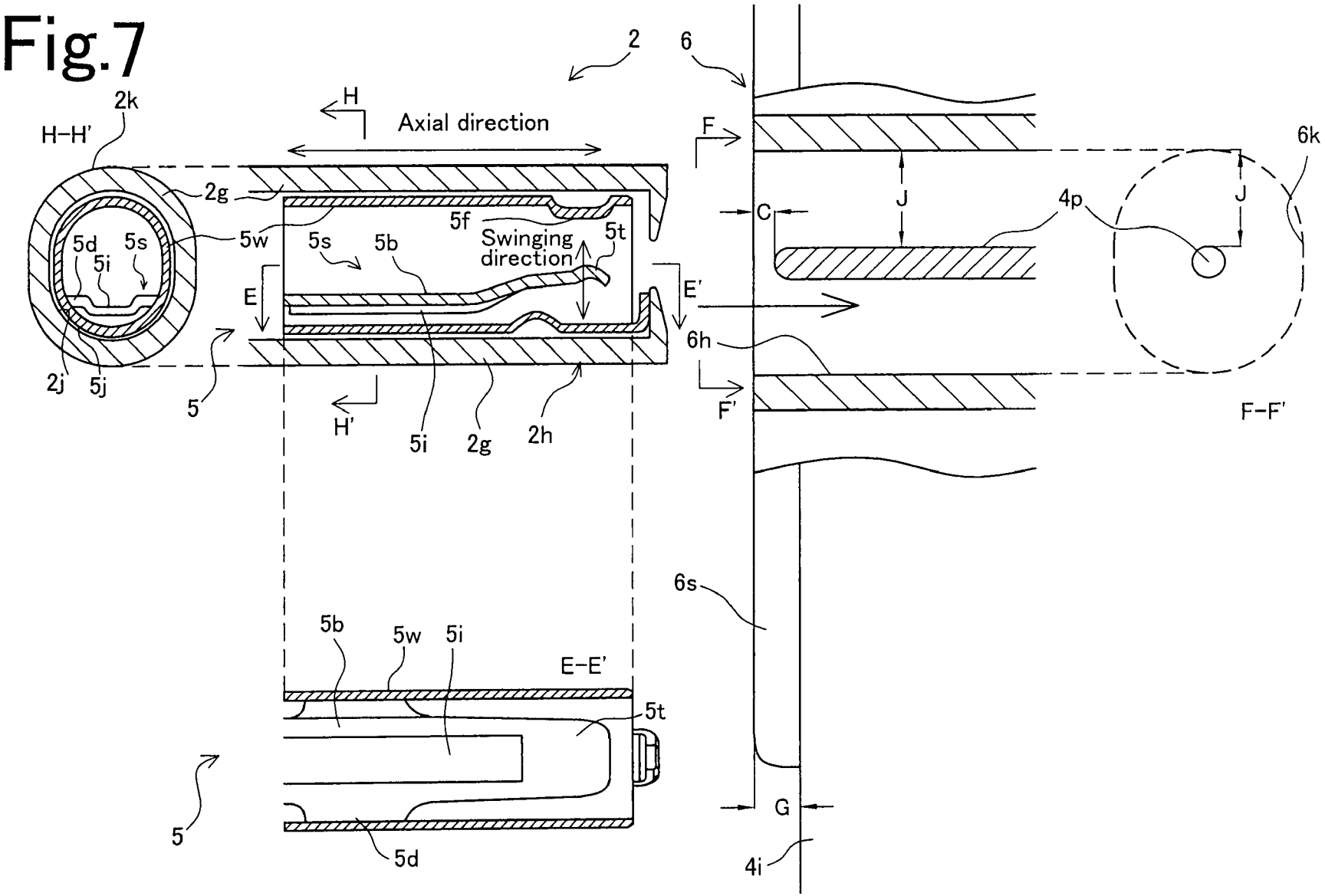
FIG. 7 is across-sectional schematic diagram of the female terminal for connector, a terminal protective part, a housing for inflator, and a short-circuiting element in a state before a plug is inserted into the short-circuiting element.
Figure 8:
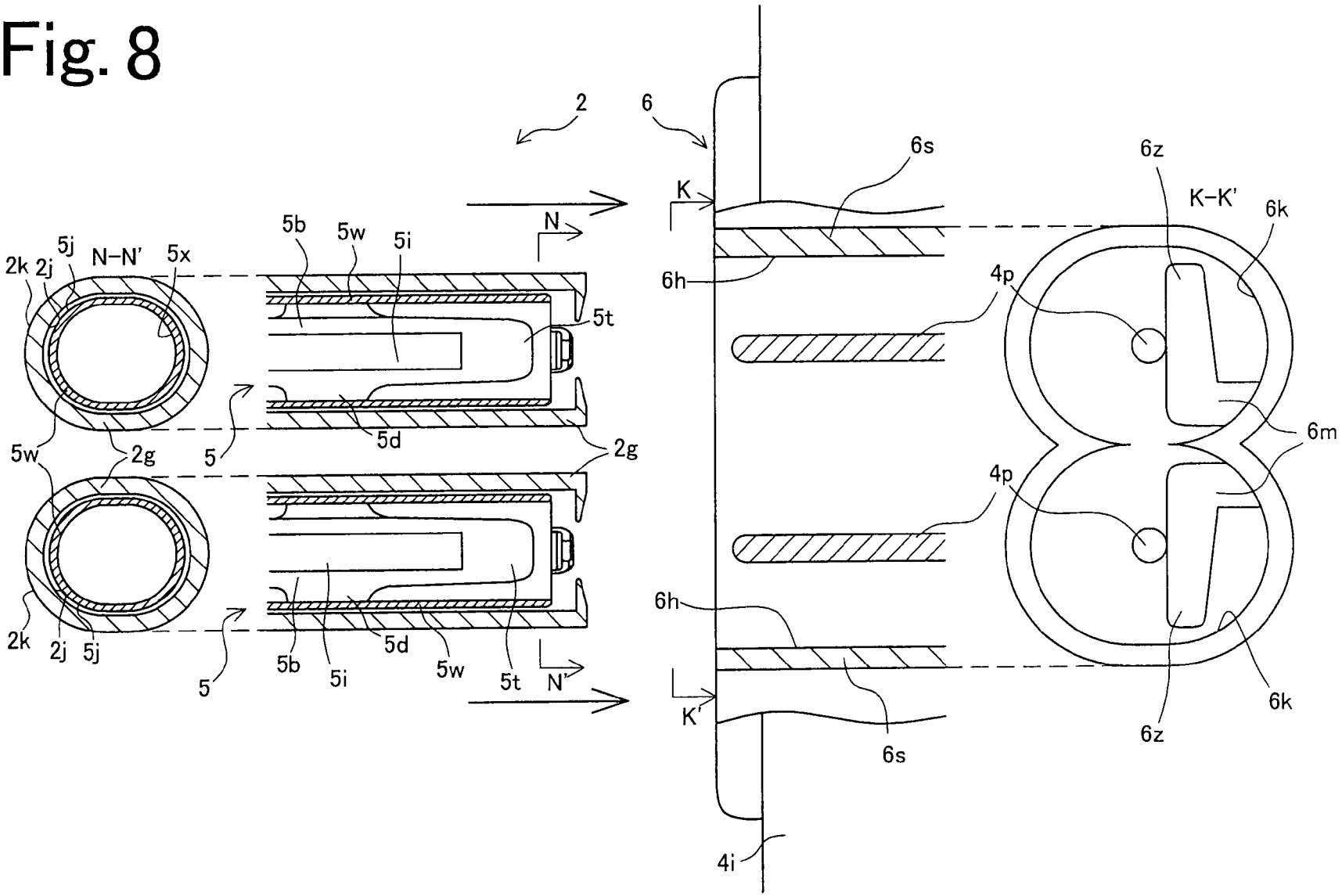
FIG. 8 is a cross-sectional schematic diagram of FIG. 7 as seen from the top surface.

Next, the female terminal for connector 5 and the terminal protective part 2*g*, and the insertion hole 6*h* of the short-circuiting element 6 into which these are inserted will be described with reference to FIG. 7 and FIG. 8. FIG. 7 is a cross-sectional schematic diagram of the female terminal for connector 5 and the terminal protective part 2*g* of the plug 2, the housing 4*i* for inflator, and the short-circuiting element 6 in a state before the plug 2 is inserted into the short-circuiting element 6. The center in the drawing is an axial cross section thereof, and an axial direction and a radial cross section in the axial cross section are shown as a cross section taken along the line E-E', a cross section taken along the line H-H', and a cross section taken along the line F-F' in FIG. 7. In addition, these cross sections taken along the lines E-E', H-H', and F-F' denote cross sections seen from the arrowed lines at the respective positions of the lines E-E', H-H', and F-F' in a case in which the central cross-sectional view is not defined as a cross section. Further, in the cross section taken along the line E-E', the terminal protective part 2*g* is omitted from being shown. Further, FIG. 8 is a cross-sectional schematic diagram seen from the top surface of FIG. 7, and the center in the drawing is an axial cross section. A radial cross section and a diagram seen from the arrowed line in the axial cross section are shown as a cross section taken along the line N-N' and a diagram seen from the arrowed line K-K' in FIG. 8. In addition, these cross sections taken along the line N-N' and diagram seen from the arrowed line K-K' denote a cross section and a diagram seen from the arrowed line at the respective positions of the lines N-N' and K-K' in a case in which the central cross-sectional view is not defined as a cross section.

As described above, the external wall part 5*w* of the female terminal for connector 5 is formed into a shape including two curved portions 5*z* and 5*z* disposed to face one another in the swinging direction of the spring part 5*s* so as to be outward convex in its radial cross section, and two joining portions 5*y* and 5*y*. Then, the terminal protective part 2*g* of the female side housing 2*h* is formed in a tubular form so as to surround a periphery in a radial direction of the external wall part 5*w*, and the terminal protective part 2*g* is formed such that an inner peripheral surface 2*j* and an outer peripheral surface 2*k* are along an outer peripheral surface 5*j* of the external wall part 5*w* in the radial cross section of the terminal protective part 2*g* (refer to the cross section taken along the line H-H' in FIG. 7 and the cross section taken along the line N-N' in FIG. 8). An appropriate clearance is ensured between (i) the female terminal for connector 5, and (ii) the terminal protective part 2*g* for making the female terminal for connector 5 be a floating gate. Meanwhile, since the terminal protective part 2*g* is an insulator for the female terminal for connector 5, the terminal protective part 2*g* is formed so that the inner peripheral surface 2*j* and the outer peripheral surface 2*k* are extended along the outer peripheral surface 5*j* of the external wall part 5*w*.

Further, the pair of insertion holes 6*h* and 6*h* formed in the short-circuiting element 6 are formed such that the inner surfaces thereof are along the outer peripheral surfaces 2*k* of the terminal protective parts 2*g* in the radial cross section of the insertion hole 6*h* (refer to the diagram seen from the arrowed line F-F' in FIG. 7 and the diagram seen from the arrowed line K-K' in FIG. 8). The reason that the insertion hole 6*h* is formed to be along the outer peripheral surface 2*k* is to form guideways for the female terminal for connector 5 and the terminal protective part 2*g* such that the female terminal for connector 5 is inserted in the axial direction of the pin 4*p* (i.e., in a predetermined state) in order to prevent a torsional deformation of the pin 4*p* by inserting the pin 4*p* in an abnormal state such as a state in which the pin 4*p* is inclined in an oblique direction to an axial direction of the pin 4*p* when the plug 2 is inserted into the socket 4*h*. As described above, the above-described shape in the radial cross section of the external wall part 5*w* is different in their sizes from, but in common with those of the terminal protective part 2*g* and the insertion hole 6*h* as well.

(Advantages)

Figure 9:
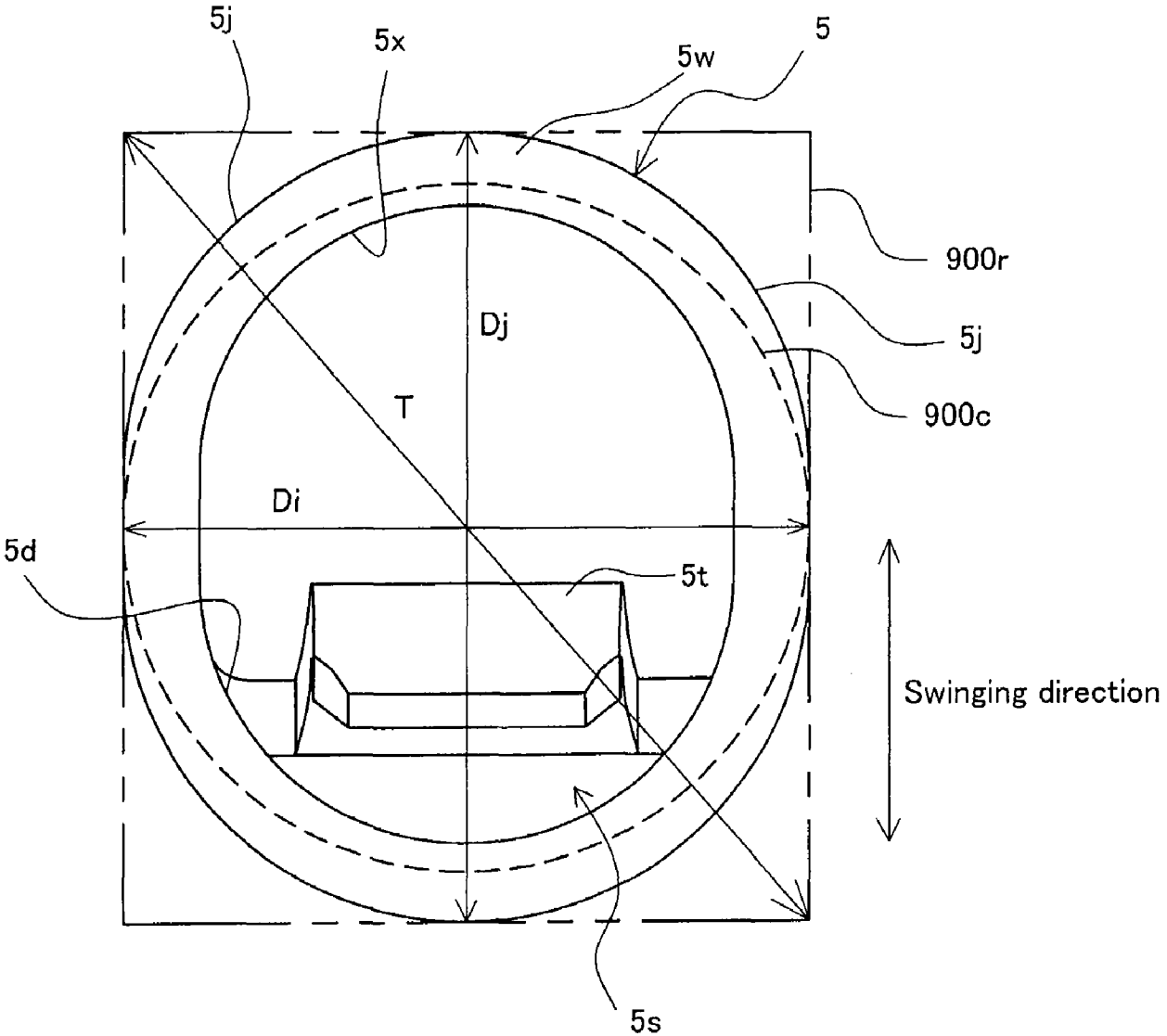
FIG. 9 is a schematic diagram showing a radial cross section of the female terminal for connector, a circle with a minimum diameter in an outer peripheral surface of the external wall part as a diameter, and a quadrangle with a minimum diameter and a maximum diameter in an outer peripheral surface of the external wall part respectively as a short side and a long side.

Next, advantages according to the present invention will be described with reference to FIG. 9. FIG. 9 shows a radial cross section of the female terminal for connector 5 according to the electrical connection device 1, and further shows a circle 900*c* with a minimum diameter (Di) in the outer peripheral surface 5*j* of the external wall part 5*w* of the female terminal for connector 5 as a diameter, and a quadrangle (rectangle) 900*r* with the minimum diameter (Di) and the maximum diameter (Dj) in the outer peripheral surface 5*j* respectively as short sides and long sides.

In the same way as in the conventional art, in a case in which the cross-sectional shapes of the female terminals for connector, the terminal protective parts, and the insertion holes in the electrical connection device are formed into circular shapes (refer to the circle 900*c* of FIG. 9), a radial distance from the pin to the inner peripheral surface of the insertion hole (which corresponds to a distance J in FIG. 7) is constant, and provided that a size of the insertion hole (refer to Di in FIG. 9) is set to be smaller in consideration of a board thickness of the female terminal for connector and the like, it possible to prevent a torsional deformation of the pin because a distance between the pin and the inner peripheral surface (which corresponds to the distance J in FIG. 7) is constant and short. On the other hand, when the spring part to ensure contact reliability with the pin is formed integrally with the external wall part of the female terminal for connector in order to simplify the structure of the female terminal for connector by reducing the number of components, the spring part contacts the external wall part when moving radially outwardly to limit its movement. Therefore, it is difficult in design to make a radial distance at which the spring part is capable of elastically swinging (an allowable distance/an amount of displacement possible for elastic swinging) greater. Therefore, it is necessary to ensure contact reliability by improving the rigidity of the main body portion of the spring part due to a plate member separated from the external wall part being attached to the main body portion of the spring part. Therefore, when the cross-sectional shapes are formed into circular shapes, there is a problem that the terminal structure becomes complicated.

On the other hand, in a case in which the cross-sectional shapes of the female terminal for connector, the terminal protective part, and the insertion hole are formed into quadrangular shapes (refer to the quadrangle 900*r* in FIG. 9), provided that the swinging direction of the spring part and a side (long side) direction as seen in the cross section are made to coincide with one another, it is difficult for the external wall part and the spring part to contact each other when the spring part moves, and it is possible to make a distance at which the spring part is capable of elastically swinging greater than that in a case in which the cross-sectional shapes are circular shapes. Therefore, even when the spring part is formed integrally with the external wall part of the female terminal for connector, it is possible to ensure contact reliability by the spring part without the structure being complicated by attaching a separate component. However, in this case, differently from a case in which the cross-sectional shapes are circular shapes, a radial distance between the pin and the inner peripheral surface is not constant. Concretely, even when a size of a short side of a cross section of a quadrangular shape is set to be smaller in consideration of a board thickness of the female terminal for connector and the like in the same way as a size of the diameter in a case of circular shapes, because a diagonal distance between the pin and the inner peripheral surface of the insertion hole (refer to a length T in FIG. 9) is made longer than a distance in a short side direction (refer to Di in FIG. 9), there is a problem that a deformation due to torsion of the pin easily occurs.

Then, in a case in which the cross-sectional shapes are formed into quadrangular shapes, in order to prevent a torsional deformation of the pin, it can be conceived that a height of the inner peripheral wall of the insertion hole (corresponding to a height C in FIG. 7) is set as high as possible as compared with the height of the pin to avoid a contact between the terminal protective part and the pin. However, as described above, a projected height of the short-circuiting element as seen in the cross section (corresponding to a height G in FIG. 7) from the top surface (a plane in which the socket is formed) of an airbag inflator is required to be made as small as possible in order to prevent breakage, deformation, and the like of the tip portion projected from the short-circuiting element. Further, it is usually difficult to set the height of the pin low for reasons of securing of an effective contact length with the female terminal for connector 5 and the like. For these reasons, in order to set the height of the short-circuiting element projected from the top surface of the inflator low, it is preferable to set the height of the inner peripheral wall of the insertion hole as low as possible.

Then, by use of the female terminal for connector 5 according to the present invention (refer to the outer peripheral surface 5*j* in FIG. 9), the radial cross-sectional shapes of an inner peripheral surface 5*x* and the outer peripheral surface 5*j* of the external wall part 5*w* of the female terminal for connector 5, the inner peripheral surface 2*j* and the outer peripheral surface 2*k* of the terminal protective part 2*g* surrounding the female terminal for connector 5, and an inner peripheral surface 6*k* of the insertion hole 6*h* in the short-circuiting element 6 are formed into shapes having two curved portions disposed to face one another so as to be outward convex, and two joining portions to linearly joint ends of the two curved portions together. Then, the two curved portions are disposed to face one another in the swinging direction of the spring part 5*s*. Then, diameters (Dj) in the swinging direction of these are longer than diameters (Di) in a direction perpendicular to the swinging direction. Therefore, a range within which the spring part 5*s* is capable of elastically swinging is made larger, and therefore, as compared with a case in which a cross-sectional shape of the external wall part 5*w* is a circular shape, it is easy to ensure contact reliability by the spring part 5*s* integrally formed therewith. In accordance therewith, it is possible to ensure contact reliability with a simple structure without attaching a separate member, i.e., without increasing the number of components.

Further, as compared with a case in which a cross-sectional shape of the external wall part 5*w* is a quadrangle, it is approximate to a circular shape, and therefore, a radial distance (refer to the distance J in FIG. 7) from the pin 4*p* disposed on the center of the insertion hole 6*h* to the inner peripheral surface 6*k* of the insertion hole 6*h* is more constant in every direction as compared with a case in which a cross-sectional shape is a quadrangle. Provided that a size of the minimum diameter of the insertion hole 6*h* is set to be smaller to the extent possible in consideration of a board thickness of the female terminal for connector 5, a board thickness of the terminal protective part 2*g*, a diameter of the pin 4*p*, a width of the spring part 5*s* (contact force and securing of a contact guarantee range with the pin 4*p*), an appropriate clearance from the spring part 5*s*, and the like, even when the female terminal for connector 5 is inserted into the short-circuiting element 6 in a direction inclining to the axial direction of the pin 4*p*, because a distance between the pin 4*p* and the inner peripheral surface of the insertion hole 6*h* is further constant and short, torsion of the pin 4*p* is difficult to occur, which makes it possible to prevent a deformation of the pin. In this way, because a torsional deformation of the pin is difficult to occur, it is possible to prevent a torsional deformation of the pin 4*p* without making the projected height of the short-circuiting element 6 (refer to G in FIG. 7) from the top surface of the housing 4*i* for inflator higher. As described above, it is possible to not only ensure contact reliability by the spring part 5*s*, but also prevent torsion of the pin (male terminal) 4*p* with a simple structure without making the height of the short-circuiting element 6 higher.

Further, because the two curved portions 5*z* in the external wall part 5*w* of the female terminal for connector 5 are circular arc shapes, it is possible to further simplify the structure of the female terminal for connector 5.

Further, in the female terminal for connector 5, the spring part 5*s* is formed in a long plank shape along the axial direction of the external wall part 5*w*, and the convex portion 5*i* formed to be along the axial direction and to project in the swinging direction is formed in the main body portion 5*b* of the spring part 5*s*. In accordance therewith, by forming the convex portion 5*i* formed to project in the swinging direction in order to increase the rigidity of the main body portion 5*b* of the spring part 5*s*, it is possible to not only make effective use of a space in the swinging direction in the radial cross section of the external wall part 5*w*, but also further improve contact reliability by the spring part 5*s*.

Further, the connector 8 includes a pair of the female terminals for connector 5 and 5, the above-described female side housing 2*h*, and the above-described short-circuiting element 6. Therefore, in accordance with the connector 8, it is possible to not only ensure contact reliability by the spring part 5*s*, but also prevent torsion of the pin 4*p* with a simple structure without making the height of the short-circuiting element 6 higher.

Further, the electrical connection device 1 according to the present invention includes the connector 8, the housing 4*i* for airbag inflator, and a pair of the pins 4*p* and 4*p*. Therefore, in accordance with the electrical connection device 1, it is possible to not only ensure contact reliability by the spring part 5*s*, but also prevent torsion of the pin 4*p* with a simple structure without making the height of the short-circuiting element 6 higher. Further, because the pin 4*p* is disposed so as to be upright from the bottom face to the vicinity of the opening of the socket 4*h*, it is easy to connect to the female terminal for connector 5.

(Modifications)

Figure 11:
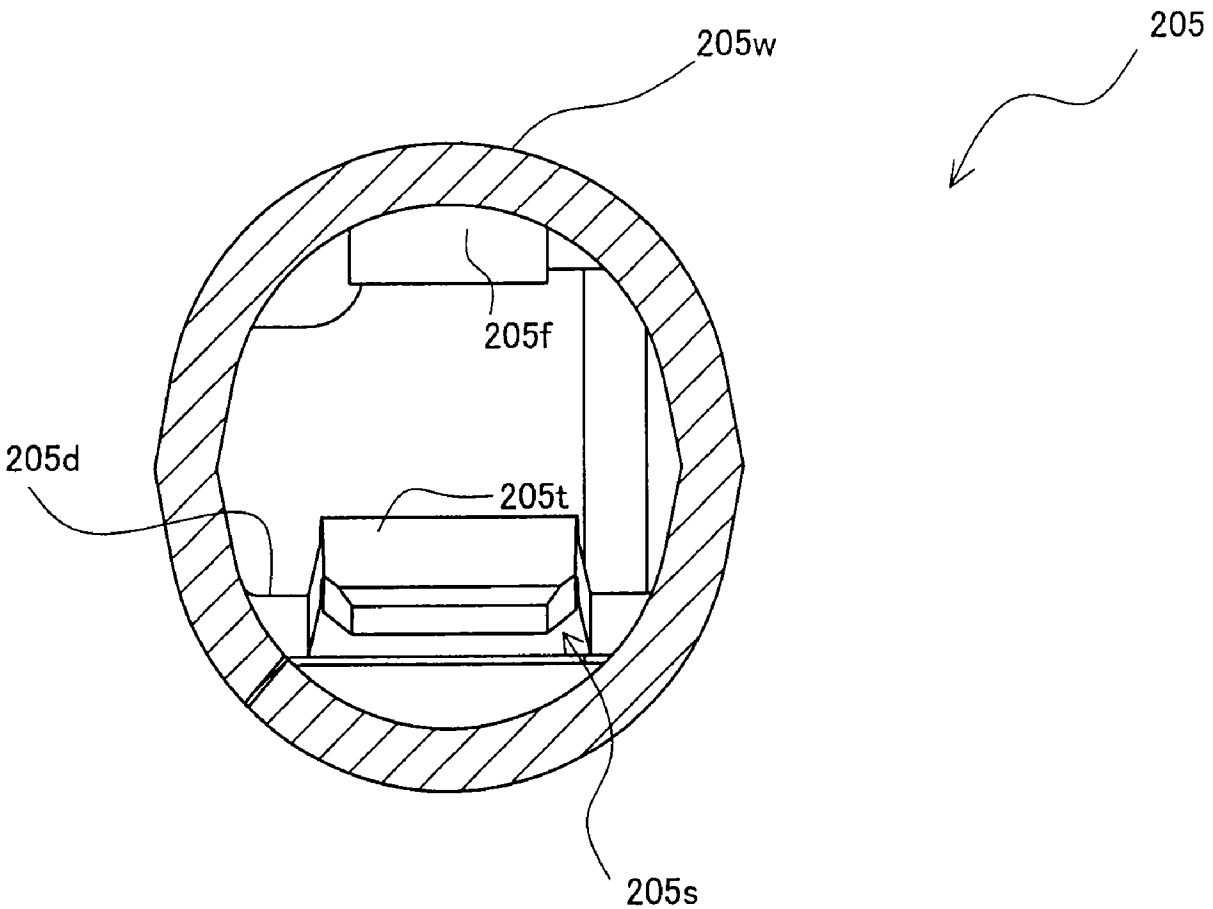
FIG. 11 is a schematic cross-sectional diagram showing a shape of a female terminal for connector according to a second modification.
Figure 12:
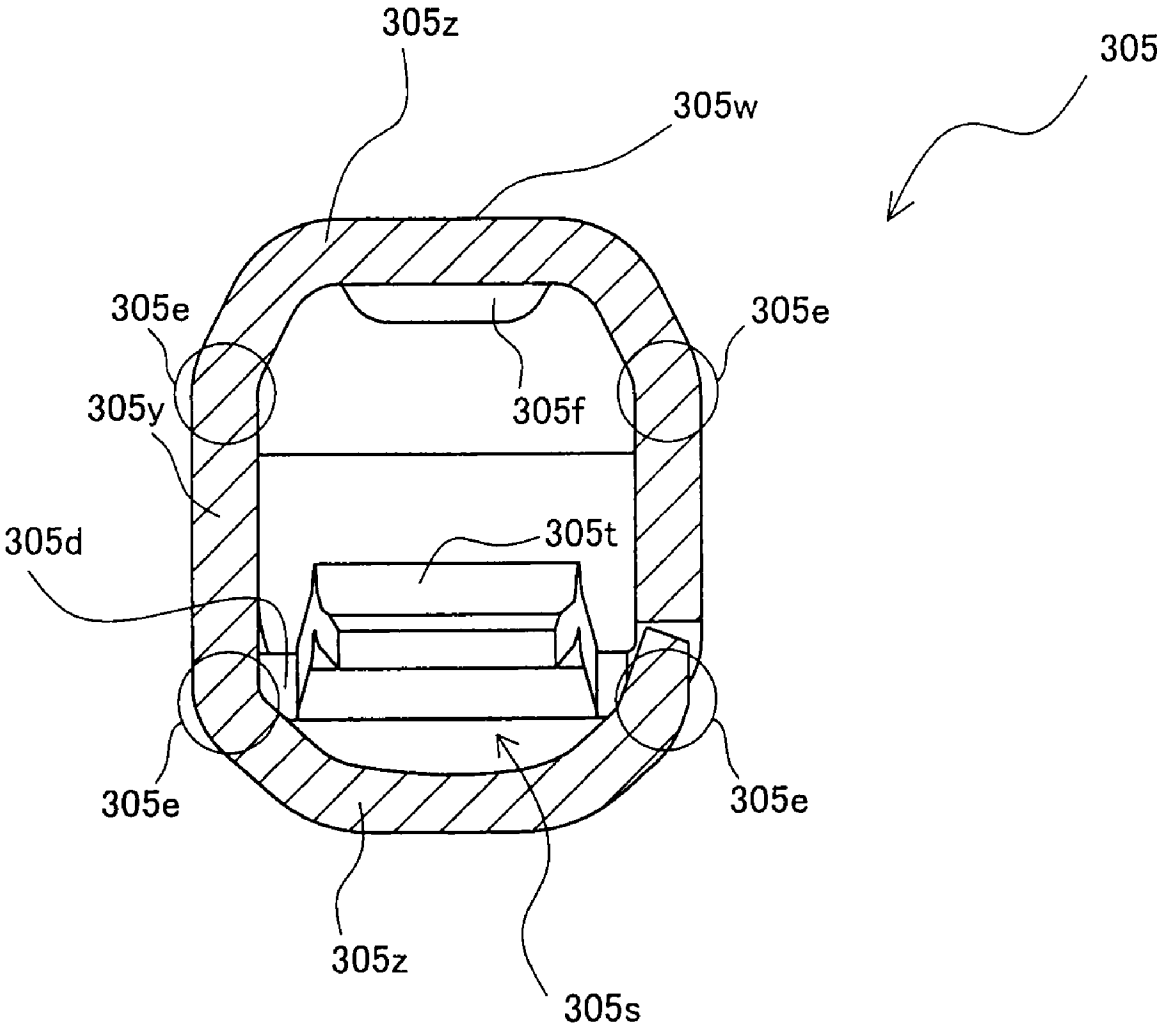
FIG. 12 is a schematic cross-sectional diagram showing a shape of a female terminal for connector according to a third modification.

Next, first to third modifications of the female terminal for connector according to the above-described embodiment will be described centering on portions different from those in the above-described embodiment with reference to FIG. 10 to FIG. 12. In addition, in FIG. 10 to FIG. 12, portions which are the same as those in the above-described embodiment are denoted by the same reference numerals, and descriptions thereof will be omitted. Further, in FIG. 10 to FIG. 12, only shapes of the female terminal for connectors are shown, and shapes of the terminal protective parts and the insertion portions of the short-circuiting elements are omitted. However, in the same way as in the above-described embodiment, the shapes of the terminal protective parts and the insertion portions of the short-circuiting elements as well conform with these shapes.

(First Modification)

First, a first modification will be described. FIG. 10 is a cross-sectional schematic diagram showing a shape of a female terminal for connector according to the first modification, and corresponds to FIG. 6 in the above-described embodiment (i.e., the cross-sectional schematic diagram seen from the arrowed line B-B'). The members or parts with reference numerals 105*d*, 105*f*, 105*j*, 105*s*, 105*w* respectively correspond to those with the reference numerals 5*d*, 5*f*, 5*j*, 5*s*, 5*w*.

Figure 10:
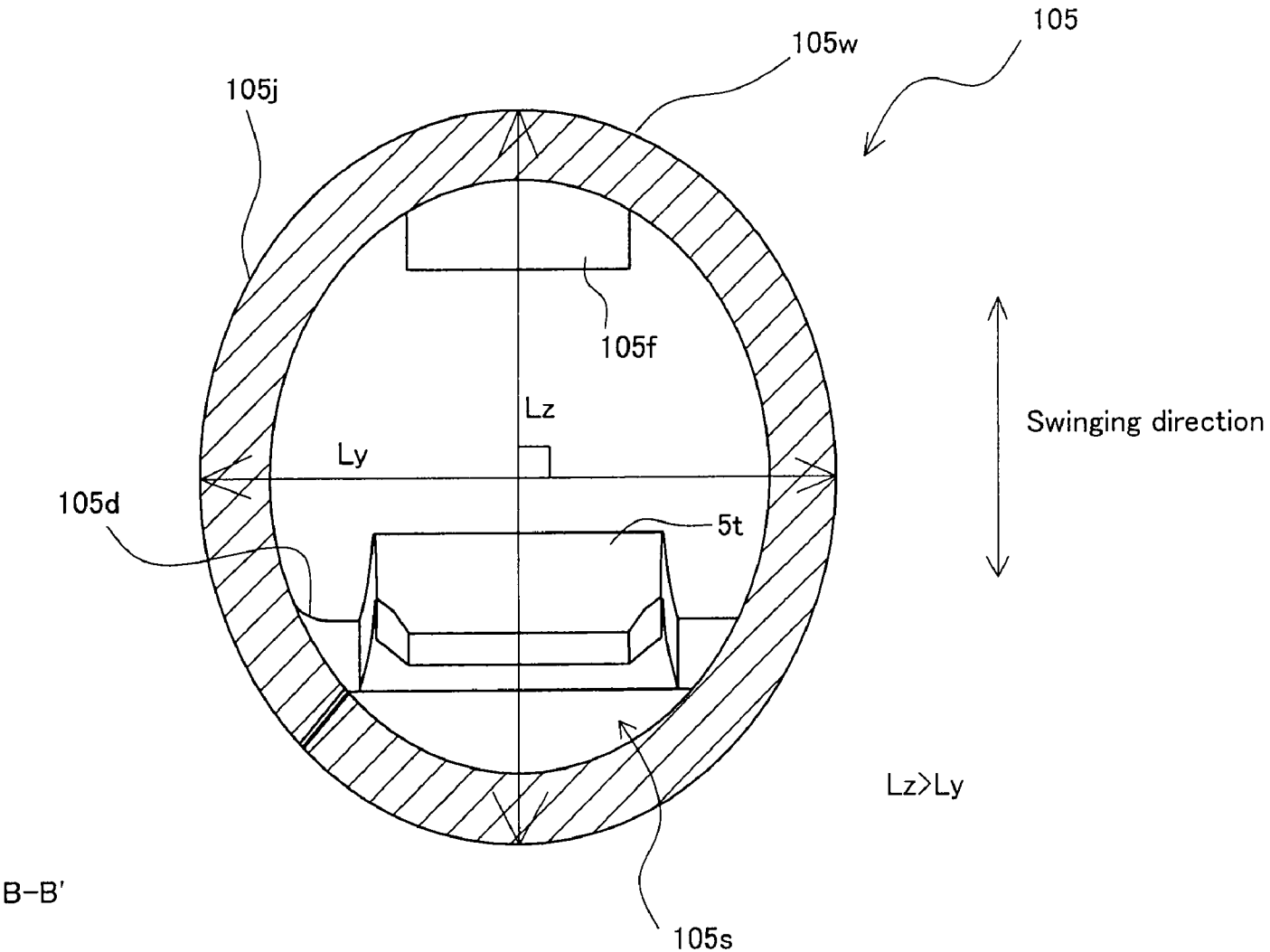
FIG. 10 is a schematic cross-sectional diagram showing a shape of a female terminal for connector according to a first modification.

In a female terminal for connector 105 according to the present modification, a shape of an external wall part 105*w* is as shown in FIG. 10, and the external wall part 105*w* is formed into an elliptic shape in the radial cross section. In the cross section of this elliptic shape, the long axis corresponds to Lz in FIG. 10, and the short axis corresponds to Ly in FIG. 10. Then, the long axis direction approximately conforms to the swinging direction of a spring part 105*s*, and in the same way as in the above-described embodiment, the long axis Lz which is the outer diameter in the swinging direction of the spring part 105*s* is longer than the short axis Ly which is the outer diameter in a direction crossing the swinging direction at a right angle. In accordance with such a structure as well, advantages which are the same as these in the above-described embodiment can be obtained.

(Second Modification)

Next, a second modification will be described. FIG. 11 is a cross-sectional schematic diagram showing a shape of a female terminal for connector according to the second modification, and corresponds to FIG. 6 in the above-described embodiment (i.e., the cross-sectional schematic diagram seen from the arrowed line B-B' in FIG. 4). The members or parts with reference numerals 205*d*, 205*f*, 205*s*, 205*t*, 205*w* respectively correspond to those with the reference numerals 5*d*, 5*f*, 5*s*, 5*t*, 5*w*.

In a female terminal for connector 205 according to the present modification, a shape thereof is not a smooth elliptic shape, but a shape including corners connecting the linear portions in the vicinity of the center in a vertical direction on the paper space. In accordance with such a shape as well, advantages which are the same as those in the above-described embodiment and the first modification can be obtained.

(Third Modification)

Next, a third modification will be described. FIG. 12 is a cross-sectional schematic diagram showing a shape of a female terminal for connector according to the third modification, and corresponds to FIG. 6 in the above-described embodiment (i.e., the cross-sectional schematic diagram seen from the arrowed line B-B' in FIG. 4). The members or parts with reference numerals 305*d*, 305*e*, 305*f*, 305*s*, 305*t*, 305*w*, 305*y*, 305*z* respectively correspond to those with the reference numerals 5*d*, 5*e*, 5*f*, 5*s*, 5*t*, 5*w*, 5*y*, 5*z*.

In a female terminal for connector 305 according to the present modification, two curved portions 305*z* and 305*z* in an external wall part are formed into arched portions composed of a plurality of linear portions connected to one another. In accordance with such a shape as well, in the same way as those in the above-described embodiment, it is possible to not only ensure contact reliability by a spring part 305*s*, but also prevent torsion of a pin with a simple structure without making the height of the short-circuiting element higher. Further, it is possible to easily form the female terminal for connector by bending work.

As described above, the embodiments of the present invention have been described. However, the present invention is not limited to the above-described embodiments, and various modifications can be implemented within a range which does not deviate from the descriptions in the scope of claims.

For example, a latching element to make a plug and a short-circuiting element be firmly engaged with one another may be provided to the plug.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A female terminal for a connector which is electrically connected to a male terminal electrically connected to a squib to ignite an airbag, the female terminal for a connector comprising:

an external wall part formed in a tubular form; and a spring part integrally formed with the external wall part inside the external wall part, the spring part contacting the male terminal during a connection to the male terminal, wherein the spring part has a main body portion and a tip portion, and continues into the external wall part at the main body portion, the tip portion is configured to swing so as to deflect from the main body portion, and the external wall part is formed into a shape having two curved portions disposed to face one another in a swinging direction of the spring part so as to be outwardly convex, and two joining portions to linearly joint ends of the two curved portions together in a radial cross section of the external wall part, and the external wall part is formed such that an outside diameter of the external wall in the swinging direction of the spring part is made larger than an outside diameter of the external wall in a direction perpendicular to the swinging direction in the radial cross section of the external wall part.

2. The female terminal for a connector according to claim 1, wherein the curved portions are circular arc shapes.

3. The female terminal for a connector according to claim 1, wherein the curved portions are composed of a plurality of linear portions joined together.

4. The female terminal for a connector according to claim 1, wherein the spring part is formed in a long plank shape along an axial direction of the external wall part, and a convex portion formed to be along the axial direction and to project in the swinging direction is formed in the main body portion.

5. A connector comprising:

a pair of the female terminals for a connector according to claim 1;

a female side housing to which the pair of female terminals for a connector are attached, the female side housing insulating the pair of female terminals for a connector; and a short-circuiting element which electrically short-circuits a pair of male terminals electrically connected to the pair of female terminals for a connector, the short-circuiting element is engaged with a concave portion provided in a housing for airbag inflator, wherein the pair of male terminals are disposed so as to be upright from a bottom face to a vicinity of an opening of the concave portion at a central part of the concave portion, the female side housing has a terminal protective part formed in a tubular form so as to surround a periphery in a radial direction of the external wall part, the terminal protective part is formed such that an inner peripheral surface and an outer peripheral surface are along an outer peripheral surface of the external wall part in the radial cross section of the terminal protective part, a pair of insertion holes into which the terminal protective part is inserted are formed in the short-circuiting element, and the insertion hole is formed such that an inner peripheral surface is along an outer peripheral surface of the terminal protective part in the radial cross section of the insertion hole.

6. An electrical connection device comprising:

the connector according to claim 5 wherein the housing for the airbag inflator has the concave portion in an outer surface thereof, and the pair of male terminals are electrically connected to a squib to ignite the airbag.

7. A female terminal for a connector which is electrically connected to a male terminal electrically connected to a squib to ignite an airbag, the female terminal for a connector comprising:

an external wall part formed in a tubular form; and a spring part integrally formed with the external wall part inside the external wall part, the spring part contacts the male terminal during a connection to the male terminal, wherein the spring part has a main body portion and a tip portion, and continues into the external wall part at the main body portion, the tip portion is configured to swing so as to deflect from the main body portion, and the external wall part is formed into an elliptic shape with a swinging direction of the spring part as a long axis direction in a radial cross section of the external wall part; wherein the external wall part is formed into a shape having two curved portions disposed to face one another in a swinging direction of the spring part so as to be outwardly convex, and two joining portions to linearly joint ends of the two curved portions together in a radial cross section of the external wall part, and the external wall part is formed such that an outside diameter of the external wall in the swinging direction of the spring part is made larger than an outside diameter of the external wall in a direction perpendicular to the swinging direction in the radial cross section of the external wall part.

8. The female terminal for a connector according to claim 7, wherein the spring part is formed in a long plank shape along an axial direction of the external wall part, and a convex portion formed to be along the axial direction and to project in the swinging direction is formed in the main body portion.

9. A connector comprising:

a pair of the female terminals for a connector according to claim 7;

a female side housing to which the pair of female terminals for a connector are attached, the female side housing insulating the pair of female terminals for a connector; and a short-circuiting element which electrically short-circuits a pair of male terminals electrically connected to the pair of female terminals for a connector, the short-circuiting element is engaged with a concave portion provided in a housing for airbag inflator, wherein the pair of male terminals are disposed so as to be upright from a bottom face to a vicinity of an opening of the concave portion at a central part of the concave portion, the female side housing has a terminal protective part formed in a tubular form so as to surround a periphery in a radial direction of the external wall part, the terminal protective part is formed such that an inner peripheral surface and an outer peripheral surface are along an outer peripheral surface of the external wall part in the radial cross section of the terminal protective part, a pair of insertion holes into which the terminal protective part is inserted are formed in the short-circuiting element, and the insertion hole is formed such that an inner peripheral surface is along an outer peripheral surface of the terminal protective part in the radial cross section of the insertion hole.

10. An electrical connection device comprising:

the connector according to claim 9 wherein the housing for the airbag inflator has the concave portion in an outer surface thereof, and the pair of male terminals are electrically connected to a squib to ignite the airbag.

* * * * *